US006135853A

United States Patent [19]

Hopson

[11] Patent Number: 6,135,853

[45] Date of Patent: Oct. 24, 2000

[54] BRA STRAP CONCEALER APPARATUS

[76] Inventor: Maria Cecilia Hopson, 20830 Lantz, Clinton Township, Mich. 48035

[21] Appl. No.: 09/535,912

[22] Filed: Mar. 24, 2000

[51] Int. Cl.[7] ..... A41D 27/10; A41C 3/06

[52] U.S. Cl. ..... 450/86; 450/1; 450/88; 2/326; 2/323

[58] Field of Search ..... 450/86, 1, 88; 2/310, 311, 312, 336, 338, 323–332; D2/624–626; 224/901.4

[56] References Cited

U.S. PATENT DOCUMENTS

| | | | |
|---|---|---|---|
| D. 383,888 | 9/1997 | Smith . | |
| 863,970 | 8/1907 | Ebersole | 2/323 |
| 1,255,717 | 2/1918 | D'Ostroph | 2/323 |
| 1,401,227 | 12/1921 | Wyeth | 450/86 |
| 1,478,773 | 12/1923 | Stocker | 450/86 |
| 1,648,776 | 11/1927 | McOrin | 450/86 |
| 1,653,288 | 12/1927 | Johnson | 2/323 |
| 2,649,639 | 8/1953 | Carlin | 450/86 |
| 4,276,884 | 7/1981 | O'Daniels | 450/86 |
| 4,612,935 | 9/1986 | Greifer | 450/86 |
| 6,006,364 | 12/1999 | Newsom et al. | 2/323 |

*Primary Examiner*—Gloria M. Hale
*Attorney, Agent, or Firm*—Harness, Dickey & Pierce, PLC

[57] ABSTRACT

The present invention provides an apparatus for concealing bra straps. The bra strap concealer being formed by a plurality of elastic members coupled to portions of the bra. Various clasping mechanisms are also disclosed.

12 Claims, 4 Drawing Sheets

BRA STRAP CONCEALER APPARATUS

BACKGROUND AND SUMMARY OF THE INVENTION

1. Technical Field

The present invention generally relates to an apparatus for concealing bra straps and, more particularly, to conceal bra straps when a sleeveless blouse of different styles is worn.

2. Discussion

Generally speaking, the exposure of bra straps for a person wearing a sleeveless blouse is a known problem. As such, devices similar to those described in Design Patent DES. 383,888 issued to Smith have been utilized. The Smith Patent discloses an ornamental design for a bra strap holder which is used to pull the bra straps together in an attempt to hold them. One problem with the design as shown in Smith is that the strap is allowed to move vertically on the wearer's back.

As such, it is an object of the current invention to provide a bra strap concealer which does not allow the vertical movement of the bra strap concealer on the wearer's back. It is further an object of the invention to provide adjustment such that the distance between the concealed bra straps can be changed depending on the design of the blouse. It is further an object of the current invention to provide a bra strap concealer whose vertical position is also adjustable.

To achieve the foregoing and other objects, a bra strap concealer is provided which is adjustable to certain garment styles such that the likelihood that a bra strap would be exposed is minimized. The present invention provides an apparatus which utilizes a plurality of elastic members to pull the bra straps out of sight. One of the members being fastenable to the back of the bra to prevent vertical movement of the bra strap concealer between the straps.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict preferred embodiments of the present invention and are not therefore to be considered limiting in scope, the invention will be described and explained with additional specificity and detail through the use of the accompanying drawings in which.

DETAILED DESCRIPTION OF THE PREFERRED EMBODIMENT

A bra strap concealer according to one embodiment of the present invention is adapted to be used with a two strap bra. A diagram of the bra strap holder 5 is shown in FIG. 1 and includes the numerous components which make up the assembly, including a first elastic member 10, a second elastic member 20, and a third elastic member 30.

Figure 1:
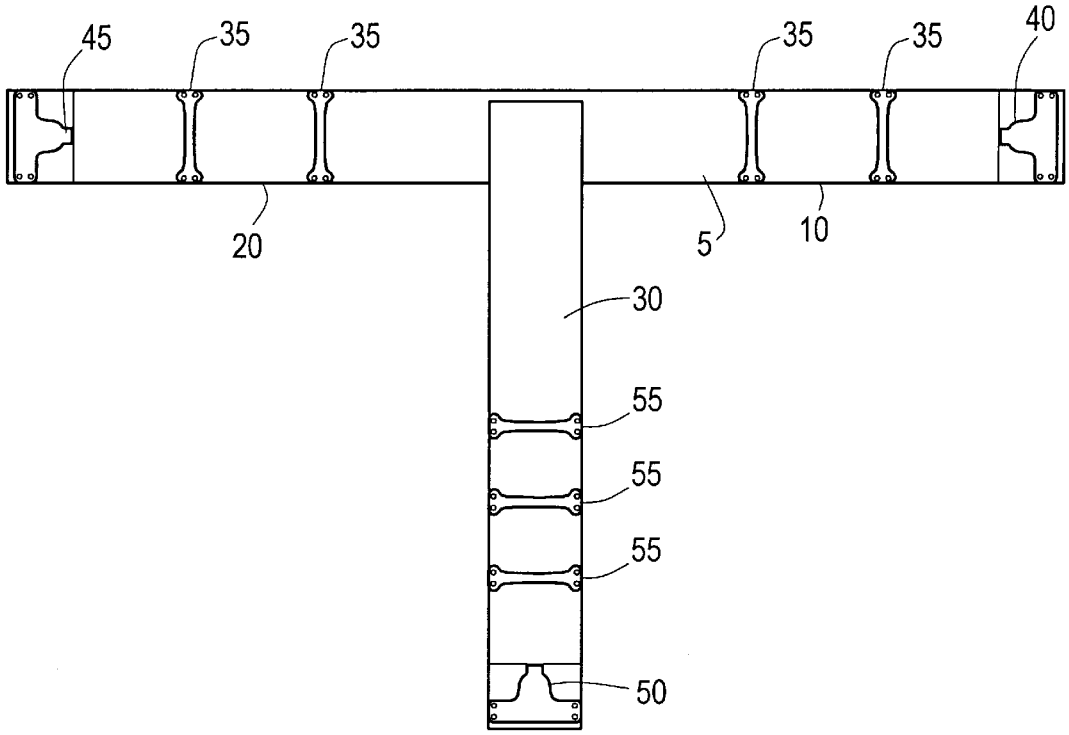
FIG. 1 is a view of the bra strap concealer when opened.

In FIG. 1, the bra strap concealer includes a first hook 40 connected to elastic member 10 for adjusting the length of elastic member 10 by coupling two clasps 35. Second elastic member 20 having a similar clasp 45 for reducing the length of member 20 by connecting two clasp members 35. Sewn to the meeting point between members 10 and 20 is elastic member 30. Elastic member 30 also having a clasp 50 for connecting to clasp members 55. Adjustment of member 30 is made to adjust the location of members 10 and 20 with respect to the back of the bra. It can be imagined that members 10 and 20 can also be a single elastic member.

Figure 2:
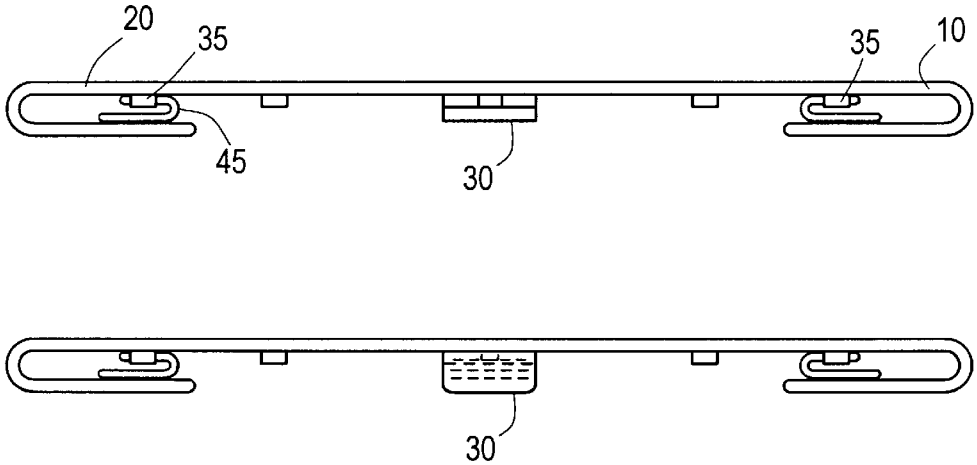
FIG. 2 is a bottom plan view.
Figure 3A:
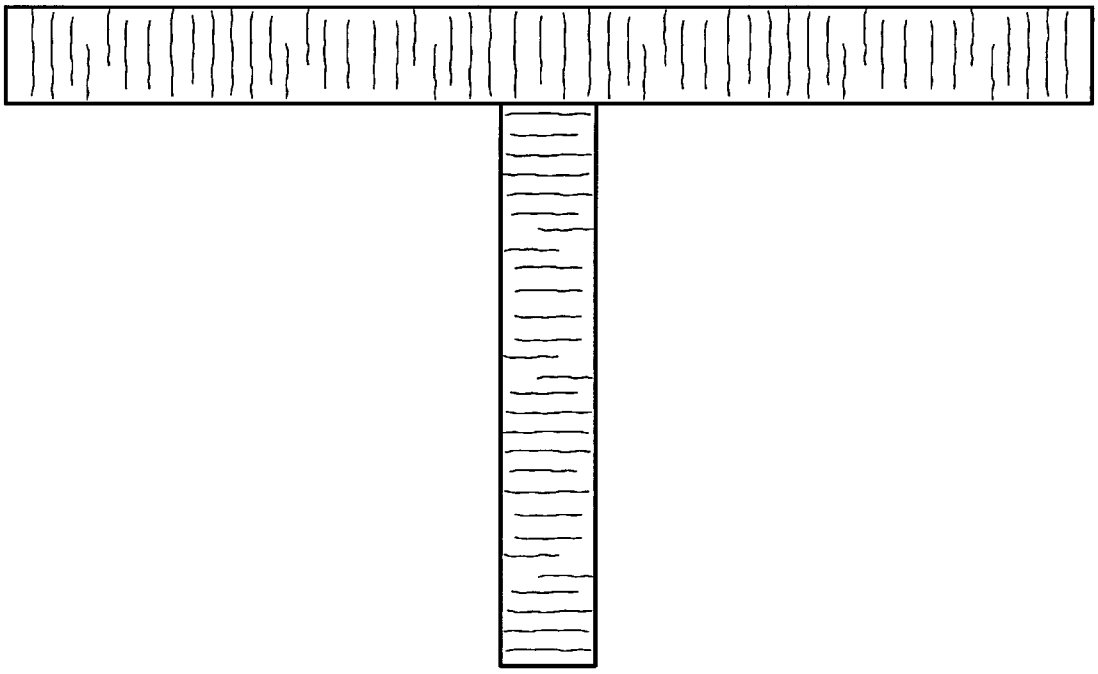
FIGS. 3*a* and 3*b* are front and back views, respectively.
Figure 3B:
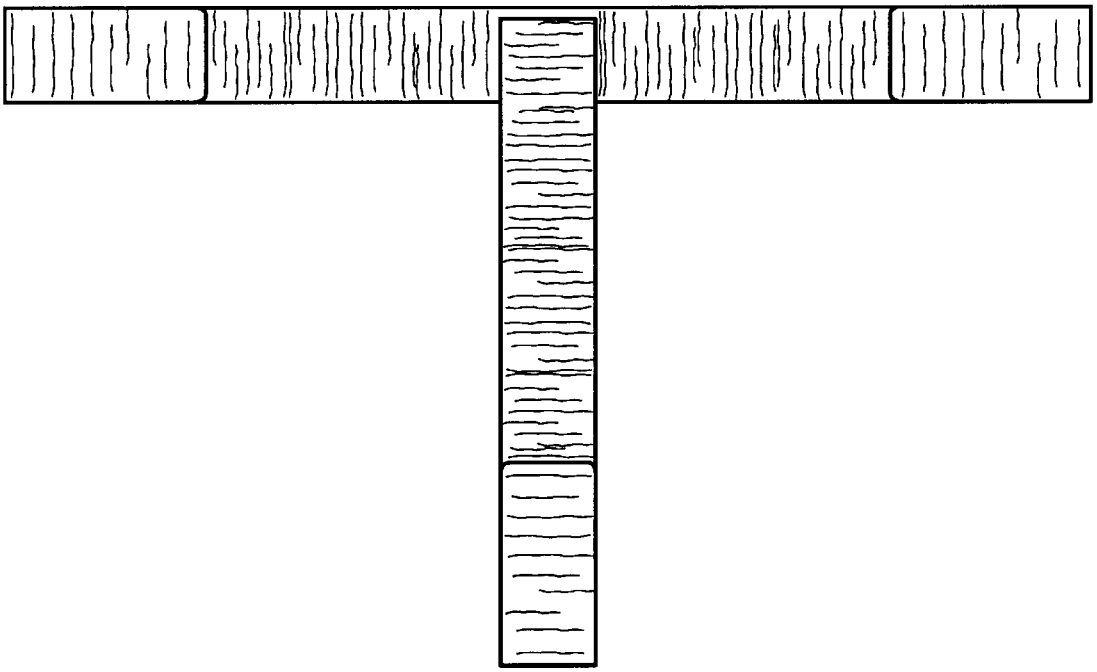
Figure 4A:
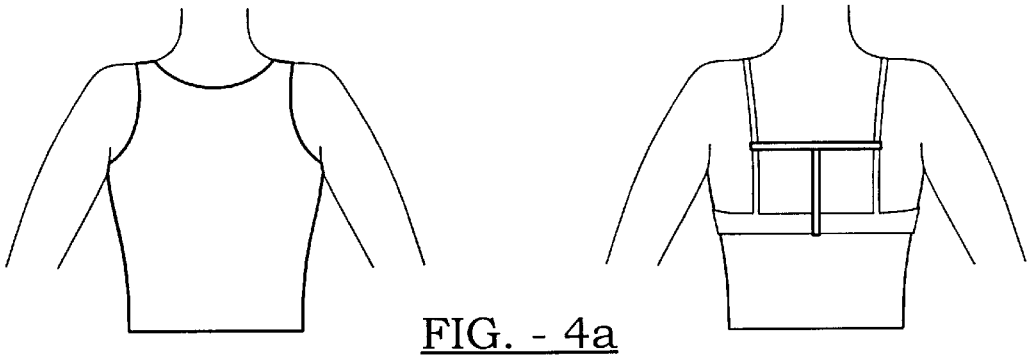
FIGS. 4*a*–4*d* represent the use of the concealer with different blouse types.
Figure 4B:
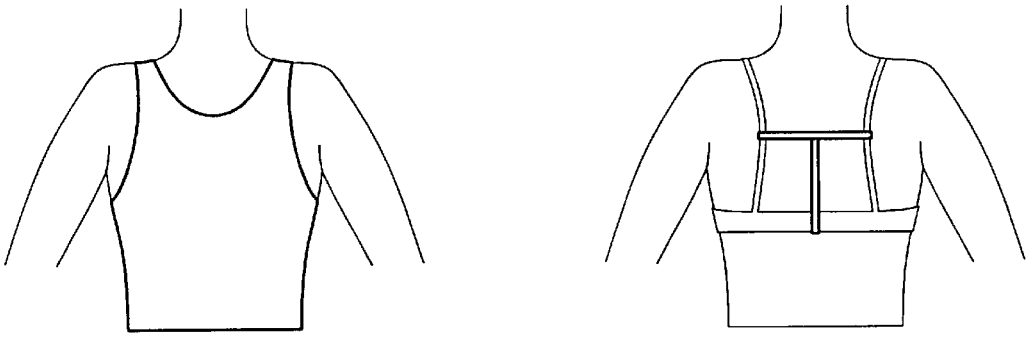
Figure 4C:
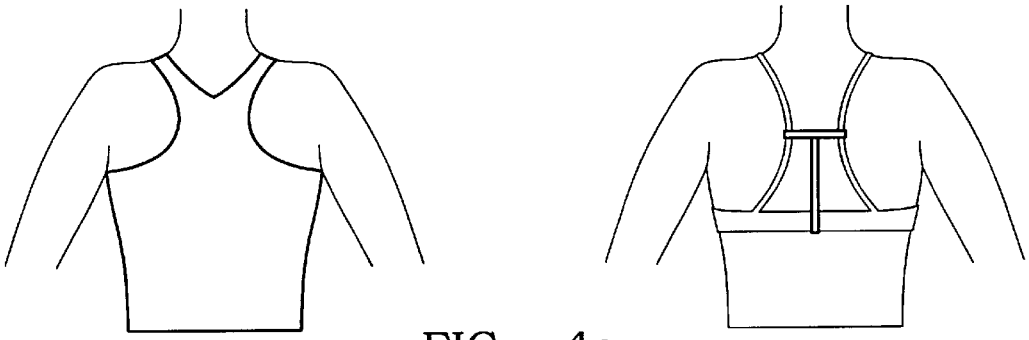
Figure 4D:
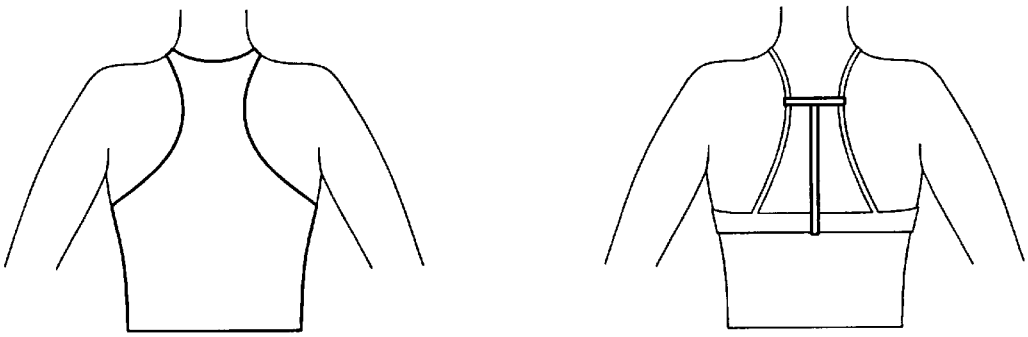

In FIG. 2, the bra strap concealer 5 is shown in a bottom plan view. Depicted is the method of engaging the clasps. The hooks 40 and 45 are connected to the clasp mechanism 35. Further depicted is more detail on the connection of elastic member with first and second elastic members 10 and 20. FIGS. 3*a* and 3*b* depicts the concealer 5 in both front and rear views.

Depicted in FIGS. 4*a*–4*d* is the use of the concealer 5 for a given blouse type. As can be seen, elastic elements 10 and 20 and 30 can be adjusted depending on the type of blouse being worn. This adjustment positions the concealer 5 in a position such that the concealer 5 and the straps are hidden.

Figure 5:
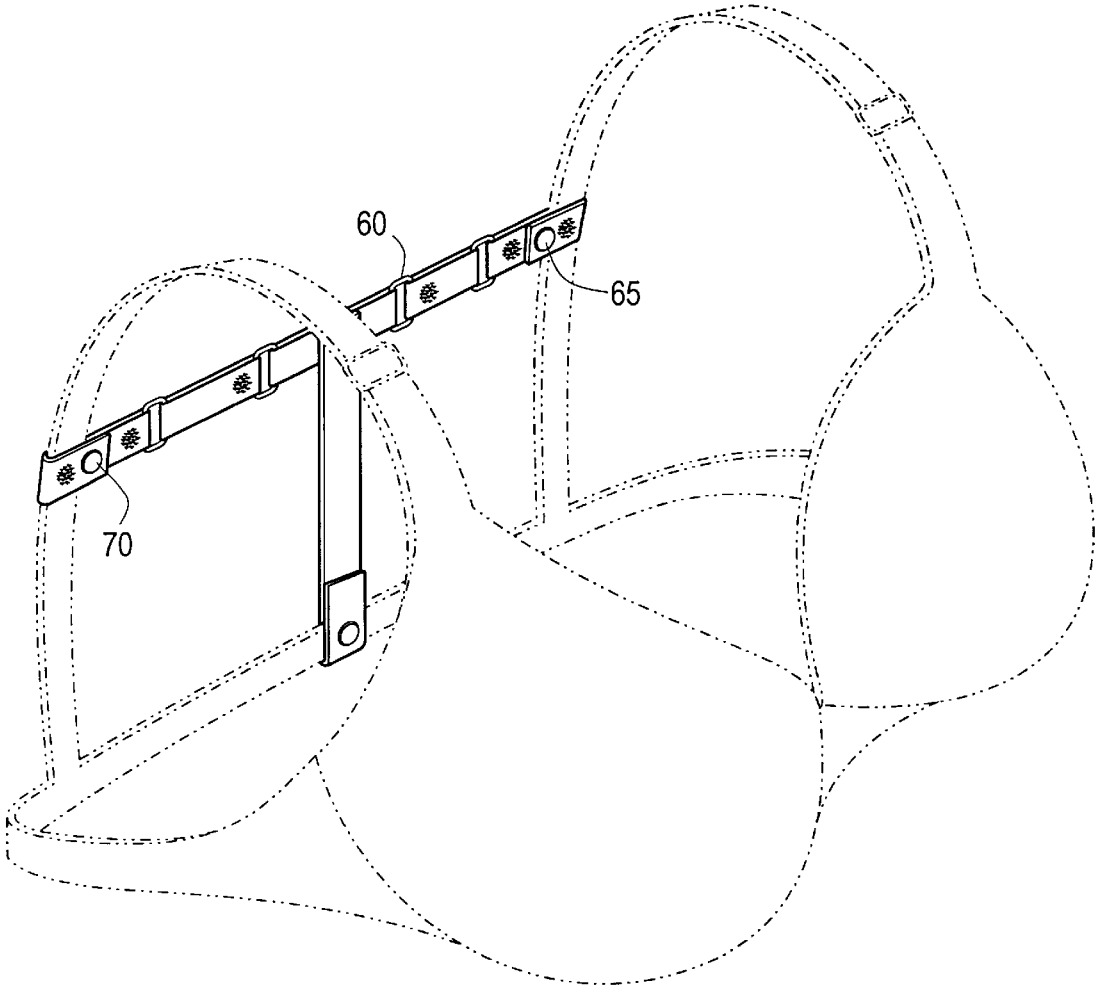
FIG. 5 is a diagram of the current invention being coupled to a bra.

In FIG. 5, a perspective view of the bra strap concealer attached to a bra is shown. A second embodiment of the invention being shown. Adjustment of the width of the first and second members 10, 20 being performed by a standard buckle assembly 60 replacing the hook elements 40, 45 are button elements 65, 70 and 80. As with all of the embodiments of the current invention, the bra strap concealer is looped around the bra straps prior to the connecting of the clasps with the connecting members. Those skilled in the art would recognize that any fabric fastening mechanism can be utilized.

Those skilled in the art can now appreciate from the foregoing description that the raw teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and the following claims.

What is claimed is:

1. A bra strap concealer for a bra having first, second and third bra straps comprising:

a first elastic member capable of being connected to the first bra strap;

a second elastic member capable of being connected to the second bra strap;

the first and second elastic members connected to each other;

a third elastic member attached to the first and second elastic members which are capable of being connected to the third bra strap.

2. The bra strap concealer of claim 1 wherein the first elastic member has a first fastening means capable of engaging the first bra strap and the second elastic member has a second fastening means capable of engaging the second bra strap.

3. The bra strap concealer of claim 2 wherein the third elastic member further has a fastening means capable of engaging said third bra strap.

4. The bra strap concealer of claim 2 wherein the first fastener means is a hook and a hook receiving member, said first fastening means allowing the first elastic member to define a loop around said first bra strap.

5. The bra concealer of claim 3 wherein the third fastener means is a hook and a hook receiving member, said third fastener means allowing the third elastic member to define a loop around said third bra strap.

6. The bra concealer of claim 4 further comprising a plurality of hook receiving members.

7. The bra concealer of claim 5 further comprising a plurality of hook receiving members.

8. The bra concealer of claim 1 wherein said first elastic member has a length adjusting means; and said second elastic member has a second length adjusting means.

9. A bra strap concealer for a bra having first, second and third bra straps consisting essentially of:

a first elastic member having a medial portion and first and second ends;

said ends having first and second attaching means capable of coupling to said first and second bra straps;

a second elastic member having first and second ends, said first end coupled generally perpendicular to said medial position;

said second end of said second elastic member having a third attaching means capable of coupling to said third bra strap.

10. The bra strap concealer of claim 9 wherein said first attaching means is a hook and a hook receiving member, whereby said first attachment means allowing the first elastic member to define a loop around said first bra strap.

11. The bra strap concealer of claim 10 wherein said first elastic member has a plurality of hook receiving members spaced at regular intervals.

12. The bra strap concealer of claim 9 wherein said third attaching means is a hook and a hook receiving member whereby said third attachment means allowing the first elastic member to define a loop around said third bra strap.

* * * * *

UNITED STATES PATENT AND TRADEMARK OFFICE

CERTIFICATE OF CORRECTION

PATENT NO. : 6,135,853

DATED : October 24, 2000

INVENTOR(S) : Maria Cecilia Hopson

It is certified that error appears in the above-identified patent and that said Letters Patent is hereby corrected as shown below:

Col. 2, line 22, delete "shown. A" and substitute --shown, a-- therefor

Col. 2, line 66, claim 5, after "bra" insert --strap--

Col. 3, line 3, claim 6, after "bra" insert --strap--

Col. 3, line 5, claim 7, after "bra" insert --strap--

Col. 3, line 7, claim 8, after "bra" insert --strap--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*